United States Patent [19]

Ross

[11] 4,159,085

[45] Jun. 26, 1979

[54] EXPANDABLE ARBOR FOR HORIZONTAL PAY-OFF REELS

[76] Inventor: Edwin H. Ross, 409 N. Mercer St., New Castle, Pa. 16101

[21] Appl. No.: 928,558

[22] Filed: Jul. 27, 1978

[51] Int. Cl.[2] ..... B65H 75/24

[52] U.S. Cl. ..... 242/110.2; 242/72.1; 242/129

[58] Field of Search ..... 242/110.1, 110.2, 110, 242/110.3, 84, 72, 72.1, 77, 78, 78.6, 115, 129, 46.3

[56] References Cited

U.S. PATENT DOCUMENTS

| | | | |
|---|---|---|---|
| 1,191,904 | 7/1916 | Luick | 242/110.1 |
| 1,443,450 | 1/1923 | Yurcich | 242/84 |
| 2,628,040 | 2/1953 | Rayburn | 242/78 |
| 2,678,175 | 5/1954 | Wiig | 242/110.2 |

*Primary Examiner*—George F. Mautz

*Attorney, Agent, or Firm*—Webster B. Harpman

[57] ABSTRACT

A horizontal pay-off reel of the so-called top hat or basket type incorporates a plurality of circumferentially spaced radially movable spacer arms positioned for movement into and out of a slotted cylindrical body. A mechanism within the cylindrical body and operable from the exterior thereof imparts horizontal motion to said spacer arms to enable the same to be positioned to match the inner diameter of a coil of wire or the like positioned on the horizontal pay-off reel.

9 Claims, 5 Drawing Figures

EXPANDABLE ARBOR FOR HORIZONTAL PAY-OFF REELS

BACKGROUND OF THE INVENTION (1) Field of the Invention

This invention relates to horizontal pay-off reels on which coils of wire or the like can be positioned and progressively unreeled therefrom in a pay-off action as necessary in supplying the wire or the like to a further processing machine.

(2) Description of the Prior Art

Prior structures of this type have generally comprised a cylindrical body with a semi-conical upper end over which a coil of wire or the like could be positioned and retained by gravity. Vertical pay-off reels have been known in the art as used with coiled material. See for example U.S. Pat. No. 2,762,577 wherein segments of a cylindrical body are arranged for radial movement relative to a common center. The device of the present invention incorporates the advantages of the heretofore known cylindrical bodies with tapered upper end portions and radially expanding arms to position and control a coil of wire or the like positioned thereon.

U.S. Pat. No. 4,061,289 shows a vertical pay-off reel with expanding segments which are actuated by sleeves traveling on a center shaft and a similar arrangement of a plurality of circumferentially expandable segments in an expansible mandrel are seen in U.S. Pat. No. 2,682,924. The present invention utilizes the simpler more efficient cylindrical body with its semi-conical upper end over which a coil of wire or the like may be readily positioned and provides for the external actuation of radially movable spacer arms for engagement uniformly with the inner surface of the coil of wire so as to properly and desirably position the same on the horizontal pay-off reel.

U.S. Pat. No. 3,128,060 shows a yarn cake holder in which spring urged radially movable segments, which are arcuate in cross section, are arranged for engagement in a yarn cake. The activating mechanism disclosed in this patent is substantially different from that in the present application and would be incapable of functioning if moved into the present environment.

U.S. Pat. No. 2,339,543 shows a collapsible form with radially movable arcuate segments of a cylinder as used in expanding a vehicle tire under construction. The operating means for moving the segments is distinctly different from that of the present invention and the construction thereof like those of the aforesaid prior art patents would be incapable of functioning in the present environment in properly holding, aligning and positioning a coil of wire or the like for desirable and efficient rapid pay-off as essential in a manufacturing operation.

SUMMARY OF THE INVENTION

An expandable arbor for horizontal pay-off reels on which coils of wire or the like are positioned for unreeling therefrom takes the form of a cylindrical body with a semi-conical upper end and has a plurality of radially movable circumferentially spaced spacer arms movable into and out of said body through vertical slots therein. Retracting the arms into or substantially into the hollow cylindrical body enables a coil of wire or the like to be quickly and easily positioned on the pay-off reel and easily operated external means is provided for moving the spacer arms radially uniformly so as to engage the inner diameter of a coil of wire or the like thereon at circumferentially spaced locations therein and hold the same in desired centered positioned with respect to the reel to facilitate rapid and efficient horizontal pay-off of the wire or the like therefrom.

DESCRIPTION OF THE PREFERRED EMBODIMENT

Figure 1:
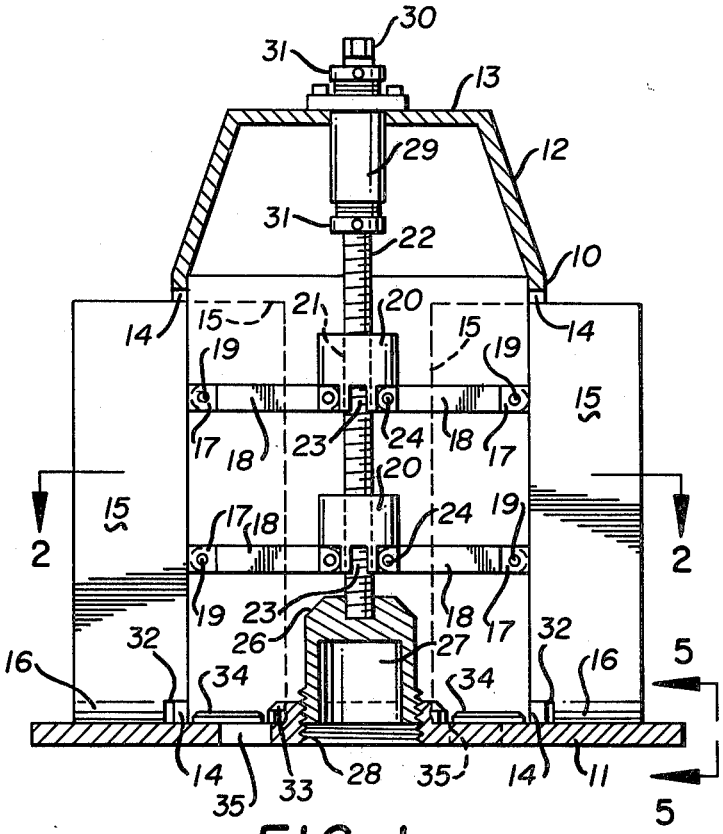
FIG. 1 is a vertical section of the expandable arbor for horizontal pay-off reels.
Figure 2:
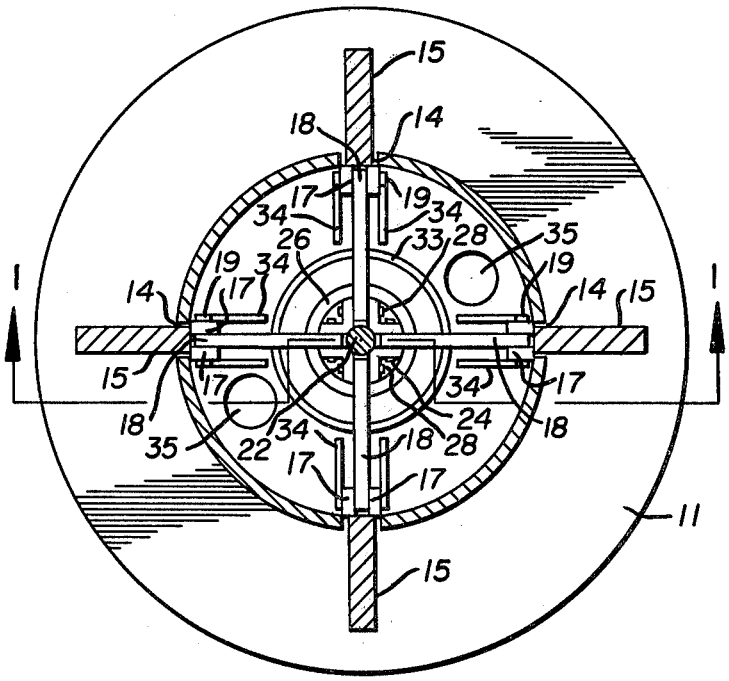
FIG. 2 is a horizontal section on line 2—2 of FIG. 1.
Figure 5:
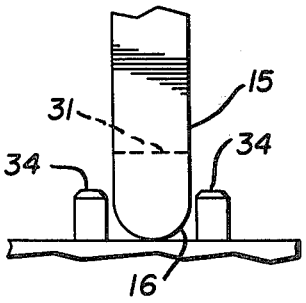
FIG. 5 is an enlarged section on line 5—5 of FIG. 1.

By referring to the drawings and FIGS. 1 and 2 in particular, an expandable arbor for a horizontal pay-off reel may be seen to comprise a cylindrical body 10 positioned vertically on a base 11 with the upper end of the cylindrical body being semi-conical in shape and inclined inwardly as at 12 to an upper end portion 13. A plurality of circumferentially spaced vertically extending slots 14 are formed in the cylindrical body 10 below the semi-conical portion 12 and extend downwardly to the uppermost surface of the base 11. A plurality of spacer arms 15 are positioned one in each of the vertical slots 14, their lower ends are transversely rounded as at 16 in FIG. 5 of the drawings for minimizing frictional engagement with the base 11 and they are provided with vertically spaced pairs of apertured brackets 17 on their inner vertical edges so that adjusting links 18 may be pivoted thereto by pivot members 19. The inner or opposite ends of the adjusting links 18 are pivoted to a pair of vertically spaced adjusting lugs 20 which have vertical threaded bores 21 therethrough and are engaged thereby in vertically spaced relation on an externally threaded vertical shaft 22 which is positioned on the vertical axis of the cylindrical body 10 as best seen in FIGS. 1 and 2 of the drawings. The inner ends of the adjustment links 18 are pivotally engaged in circumferentially spaced cutaway areas 23 in the lower portions of the adjusting lugs 20 and are pivotally secured thereto by pivots 24 positioned through bores 25 therein.

Figure 3:
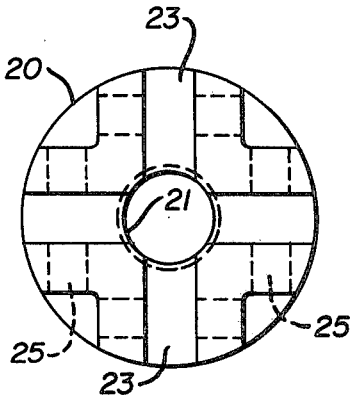
FIG. 3 is an enlarged top plan view of one of a pair of internally threaded adjusting lugs seen in FIG. 1 of the drawings.
Figure 4:
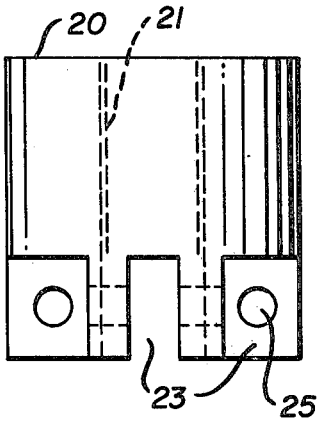
FIG. 4 is a side elevation thereof.

In FIGS. 3 and 4 of the drawings, enlarged views of the adjusting lugs 20 and their cutaway areas 23 and the transverse bores 25 may be seen. The lower end of the vertical shaft 22 is journaled in a bearing block 26 which is formed on the upper end of a tubular body member 27, the lower exterior portion thereof is threadably engaged, for vertical adjustment, in a threaded bore 28 in the base 11. The upper end of the vertical shaft 22 is positioned through a flanged tubular member 29 in an opening in the upper end 13 of the cylindrical body 10. The shaft 22 is provided with a squared or hexagon shaped extension 30 so that it can be rotated as by a tool engaged thereon. Annular members 31 are adjustably positioned on the vertical shaft 22 above and below the tubular member 29 and form adjustable stop means with respect to the upward travel of the uppermost one of the adjusting lugs 20 and thereby limits the degree of inward motion of the spacer arms 15 as the same will move inwardly of the slots 14 in the cylindrical body member 10 to the positions illustrated in broken lines in FIG. 1 when the threaded adjusting lugs 20 move upwardly on the vertical shaft 22 when it is rotated. The adjustability of the bearing block 26 performs a similar function with respect to the downward movement of the lowermost one of the threaded adjusting lugs.

Still referring to FIG. 1 of the drawings, it will be observed that the lower innermost corners of each of the spacer arms 15 is notched as at 32 so that the corner portions of each of the spacer arms 15 will not engage an annular shoulder 33 on the base 11 and around the tubular boby member 27 when the spacer arms 15 move inwardly to the position shown in broken lines. Several pairs of guides 34 on the base 11 insure the proper location of the spacer arms 15 when they move inwardly relative to the vertical slots 14 in the cylindrical body member 10 responsive to rotary motion applied to the vertical shaft 22. Engagement of the lower ends of the spacer arms 15 between the guides 34 when moved will prevent wedging action of the same against the sides of the cylindrical body member 10 defining the vertical slots 14 as will be understood by those skilled in the art.

The interior of the tubular body member 27 provides a socket for the reception of a shaft of a support means (not shown) by which the expandable arbor may be located in a desired position. Apertures 35 in the base 11 spaced with respect to the central tubular body member 27 enable drive pins (not shown) to be engaged therein so as to enable controlled motion to be imparted to the expandable arbor of the invention.

It will thus be seen that an expandable arbor for a horizontal pay-off reel has been disclosed which is of simple durable construction and enables the adjustable arms 15 thereof to be retracted into the cylindrical body 10 of the device to facilitate the placement of a coil of wire or the like thereover whereupon the adjustable spacer arms 15 may be readily moved outwardly to properly engage and position a coil on the device for a desirable horizontal pay-off action.

Although but one embodiment of the present invention has been illustrated and described, it will be apparent to those skilled in the art that various changes and modifications may be made therein without departing from the spirit of the invention, and having thus described my invention what I claim is:

1. An expandable arbor in a horizontal pay-off reel and comprising a hollow body member having a plurality of elongated slots spaced circumferentially thereof, upper and lower ends of said hollow body member, a plurality of vertically standing spacer arms arranged for radial movement into and out of said hollow body through said slots, said slots terminating inwardly of the upper end of said hollow body, a threaded shaft disposed axially of said hollow body and means on the upper and lower ends of said hollow body rotatably positioning said threaded shaft, at least two adjusting lugs having threaded bores therethrough threadably engaged on said threaded shaft in spaced relation to one another and links pivotally connected to said adjusting lugs and to said spacer arms, said links being of a length so as to extend between said adjusting lugs and the spacer arms when the spacer arms have moved to a position substantially outwardly of said slots and said links are substantially horizontal.

2. The expandable arbor for a horizontal pay-off reel set forth in claim 1 and wherein the upper end of the hollow body is of semi-conical shape and the vertical slots terminate therebelow.

3. The expandable arbor for a horizontal pay-off reel set forth in claim 1 and wherein the spacer arms are rectangular sections of material positioned on end and have pairs of spaced apertured brackets on their inner vertical edges to which said links are pivoted.

4. The expandable arbor for a horizontal pay-off reel set forth in claim 1 and wherein said means at the upper end of said hollow body is adjustable vertically so as to provide an upward limit for the upper one of said adjusting lugs on said threaded shaft.

5. The expandable arbor for a horizontal pay-off reel set forth in claim 1 and wherein said means on the upper end of said threaded shaft extends above the upper end of said hollow body member and has a configuration for the reception of a tool by which the same may be rotated.

6. The expandable arbor for a horizontal pay-off reel set forth in claim 1 and wherein said adjusting lugs are annular members with vertically threaded bores therethrough and cutaway areas in their lower portions and wherein the inner ends of said links are pivoted in said cutaway portions whereby the positioning of said links prevents rotation of said adjusting lugs on said threaded shaft.

7. The expandable arbor for a horizontal pay-off reel set forth in claim 1 and wherein pairs of spaced guide members are formed on said lower end inwardly of said hollow body member for slidably receiving the lower ends of said spacer arms when the same are substantially within said hollow body member.

8. The expandable arbor for a horizontal pay-off reel set forth in claim 1 and wherein said means on the lower end of said hollow body rotatably positioning said threaded shaft in adjustably positioned in relation to said base to limit the downward travel of the lower one of the thrust bearings on said threaded shaft.

9. The expandable arbor of claim 8 and wherein said means on the lower end of said hollow body comprises a tubular body member having a bearing block and socket in its upper end and wherein its lower end is threaded on its exterior and engaged in a threaded bore centrally of said base.

* * * * *